United States Patent [19]

Diehm

[11] Patent Number: 5,065,917

[45] Date of Patent: Nov. 19, 1991

[54] DEVICE FOR PULLING BOOTS ON WITH HANDLE AND CLAMP

[76] Inventor: Martin R. Diehm, Rte. 1, Box 99, Red Rock, Okla. 74651

[21] Appl. No.: 526,026

[22] Filed: May 21, 1990

[51] Int. Cl.[5] ..... A47G 25/80

[52] U.S. Cl. ..... 223/113; 223/111

[58] Field of Search ..... 223/113, 111, 114, 116, 223/118, 119

[56] References Cited

U.S. PATENT DOCUMENTS

| | | | |
|---|---|---|---|
| 582,484 | 5/1897 | Pendergast | 223/114 |
| 1,116,797 | 11/1914 | Carmichael et al. | 223/113 |
| 1,238,432 | 8/1917 | Orr et al. | 223/119 |
| 3,784,067 | 1/1974 | Hicks | 223/114 |
| 4,709,839 | 12/1987 | Tucker | 223/119 |
| 4,966,316 | 10/1990 | George et al. | 223/113 |

FOREIGN PATENT DOCUMENTS

| | | | |
|---|---|---|---|
| 170596 | 4/1906 | Fed. Rep. of Germany | 223/116 |
| 318876 | 12/1920 | Fed. Rep. of Germany | 223/119 |
| 95969 | 9/1922 | Switzerland | 223/119 |

*Primary Examiner*—Werner H. Schroeder

*Assistant Examiner*—Bibhu Mohanty

*Attorney, Agent, or Firm*—William S. Dorman

[57] ABSTRACT

A boot puller for pulling a boot onto the foot of a wearer comprising an elongated hollow tube having an upper fixed handle and a lower boot engaging portion, the boot engaging portion including a housing, a clamp pivotally mounted in the housing, a vertical stop normally spaced from the pivotal clamp, a vertical rod extending downwardly from above the top of the vertical tube, through the tube, and to a lower end which operatively connects with the pivotal clamp so as to move the clamp toward the stop upon lifting of the rod, the rod having an upper end which connects to the center of a short horizontal and moveable handle, whereby when the boot puller is slipped over the upper rear end of a boot such that the end of the boot is positioned between the clamp and the stop, the wearer can place his fingers beneath the moveable handle while the wearer's foot is inserted into the boot, the rod is urged upwardly while the clamp pivots so that the boot is gripped between the clamp and the stop, and whereby continued lifting against the moveable handle will cause the boot to slip onto the foot of the wearer.

4 Claims, 2 Drawing Sheets

DEVICE FOR PULLING BOOTS ON WITH HANDLE AND CLAMP

BACKGROUND OF THE INVENTION

1. Field of the Invention

The present invention relates to a boot puller. More particularly, the present invention involves a device which will aid the boot wearer in putting his boot onto his foot.

2. The Prior Art

There has always existed the problem of putting boots on the feet of the wearer. Conventional shoe horns are generally inadequate because of the length of the boot above the heel. Some wearers have attempted to use elongated shoe horns, but they are awkward to handle.

A preliminary search was conducted on the above invention and the following U.S. Patents were uncovered in the search:

| Inventor | U.S. Pat. No. | Issue date |
|---|---|---|
| Wheeler | 28,927 | June 26, 1860 |
| Von Taxis | 954,061 | April 5. 1910 |
| Cromy | 1,290,911 | January 14, 1919 |
| Hilton | 2,571,447 | October 16, 1951 |
| Parish | 3,380,634 | April 30, 1968 |

None of the above patents are deemed sufficiently close to warrant any comment.

SUMMARY OF THE INVENTION

The boot pulled of the present invention consists of an elongated hollow tube having an upper fixed handle or yoke and a lower boot engaging portion.

The boot engaging portion includes a vertical arm or stop which is normally spaced from a pivotal clamp. A vertical rod extends downwardly from above the top of the vertical tube, through the tube, and to a lower end which connects pivotally to a triangular plate. The upper end of the rod is connected to the center of a short horizontal rod which constitutes a moveable handle.

A clamp is pivotally connected to the triangular plate which, in turn, is pivotally connected to the housing for the boot engaging portion. The left hand vertical edge of the clamp, which is concave, is connected to a strip of leather, rubber or other suitable material for engaging the boot. Another strip of leather or rubber is connected to the inboard edge of the stop, which is convex. The protective strips are adjacent but spaced from each other.

The arrangment of the pivotal connections from the clamp to the triangular plate and from the triangular plate to the housing is such that an upward lifting of the rod will cause the clamp to move towards the stop. If the boot pulled is slipped over the upper read end of a boot such that the end of the boot is positioned between the clamp and the stop, the fingers of the wearer are simply placed beneath the movable handle, and the wearer's foot is inserted into the boot. The rod is urged upwardly while the triangular plate pivots and the boot is gripped between the leather strips. Continued lifting against the moveable handle will cause the boot to slip onto the foot of the wearer. Thereafter, pressure on the moveable handle is released and the boot puller can be removed from the boot by lifting upwardly on the fixed handle.

BRIEF DESCRIPTION OF THE DRAWINGS

FIG. 1 also represents a view taken along line 1—1 of FIG. 2.

DETAILED DESCRIPTION OF THE PREFERRED EMBODIMENTS

Figure 1:
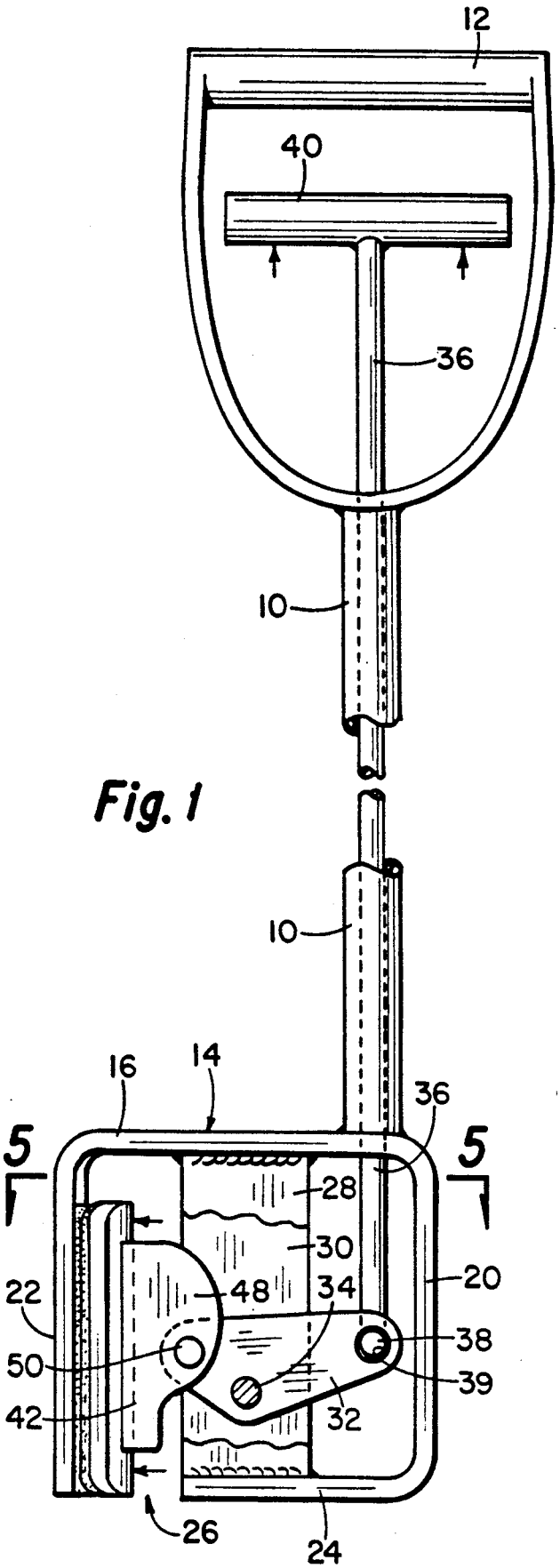
FIG. 1 is a front elevation, which parts broken away to indicate a greater vertical height of the device as compared to the height of the figure, showing the boot puller of the present invention in the boot-engaging mode, but without the boot.

Referring to the drawings in detail, the boot puller consists of an elongated hollow tube 10 having an upper fixed handle or yoke 12 and a lower boot engaging portion 14.

The boot engaging portion 14 constitutes a housing which includes a horizontal arm 16 connected at one side end to the lower end of the tube 10 and which also connects with a pair of vertical arms 20 and 22. The lower end of the arm 20 connects with a narrow horizontal plate 24 which extends toward the vertical arm 22 but terminates at a spaced distance therefrom to form an opening 26.

Figure 3:
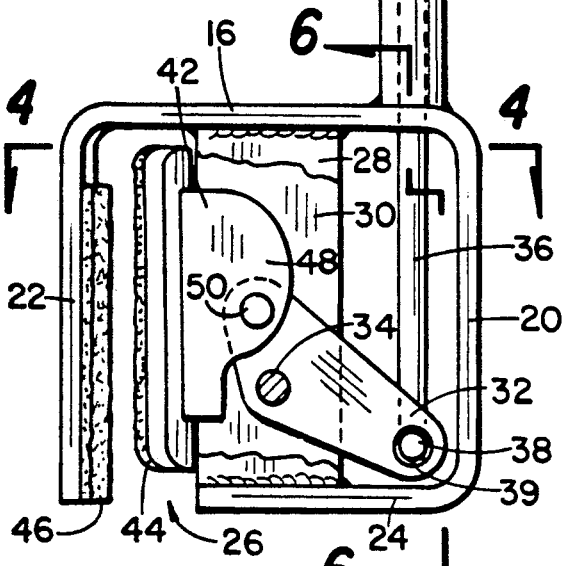
FIG. 3 is a front elevation, similar to FIG. 1, but showing the boot puller of the present invention in the relaxed or released mode.
Figure 6:
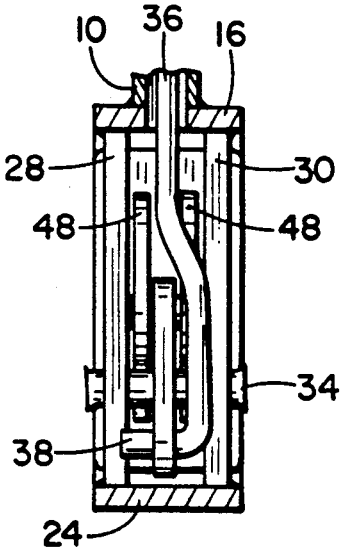
FIG. 6 is a sectional view taken along section line 6—6 of FIG. 3.

A pair of spaced vertical plates 28 and 30 extend upwardly from the sides of the plate 24 and connect at their upper ends with the arm 16 to the left of the tube 10 (in relation to FIGS. 1 and 3). A triangular plate 32 is mounted between the two plates 28 and 30 and is pivotally connected thereto by means of pin 34 which passes through a hole in the plate 32 and is secured at its ends to the plates 28 and 30. A vertical rod 36 extends downwardly from above the top of the vertical tube 10, through the tube 10, and to a lower end 38 which is bent at right angles to the rod 36 and which engages a hole 39 in the triangular plate 32. The upper end of the rod 36 is connected to the center of a short horizontal rod 40 which constitutes a moveable handle.

Figure 4:
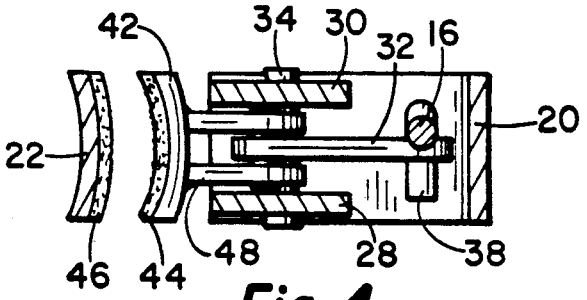
FIG. 4 is a sectional view taken along section line 4—4 of FIG. 3.
Figure 5:
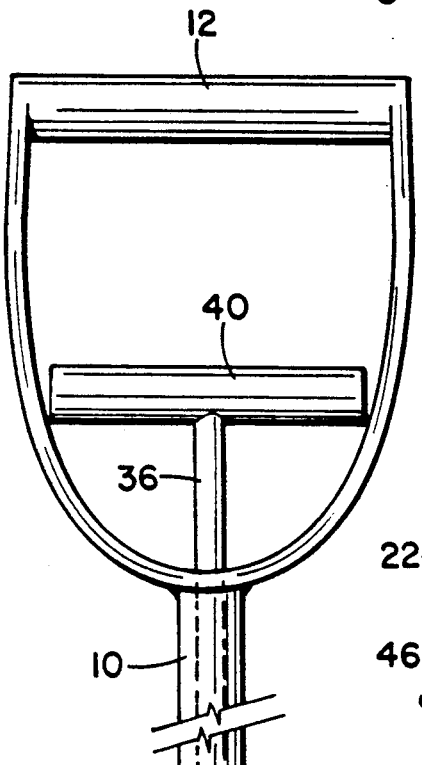
FIG. 5 is a sectional view taken along section line 5—5 of FIG. 1, showing a portion of the boot grasped between two elements of the boot puller.
Figure 5:
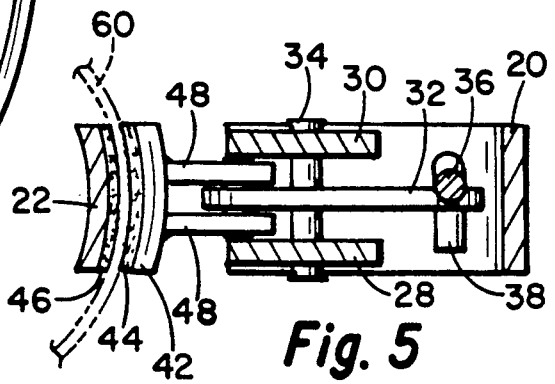

A clamp 42 is also mounted between the two vertical plates 28 and 30. The left hand vertical edge of the clamp 42, which is curved (concave) as shown in FIGS. 4 and 5, is connected to a strip 44 of leather, rubber or other suitable leather-engaging material for engaging the boot. Another strip 46 of similar protective material is connected to the inboard edge of the vertical arm 22, which is also curved (convex) as shown in FIGS. 4 and 5. As shown in FIGS. 3 and 4, the protective strips are adjacent but spaced from each other.

The clamp 42 is provided with a pair of spaced ears 48 which extend over the left hand end of the triangular plate 32. Another pin 50 whose ends connect with the ears 48 passes through a suitable hole in the plate 32. The hole for the pin 50 is located on the opposite side of the pin 34 from the hole 39. The arrangement of the pins and the holes in the plate 32 is such that an upward lifting of the rod 36 will cause the clamp 42 to move towards the vertical arm 22.

Figure 2:
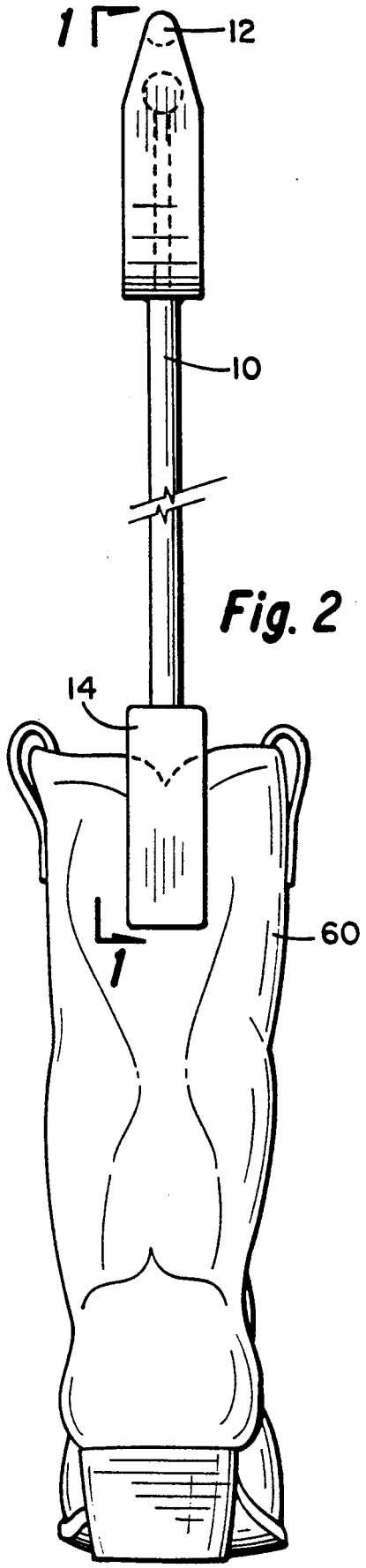
FIG. 2 is a right side elevation from FIG. 1, with parts broken away, showing the boot puller of the present invention engaging the upper rear end of a boot.

If the boot puller, as shown in FIG. 3 is slipped over the upper rear end of a boot 60, as shown in FIG. 2, such that the end of the boot is positioned between the clamp 42 and the vertical arm 22, the fingers (not shown) are simply placed beneath the moveable handle 40, and the person's foot (not shown) is inserted into the boot. The rod 36 is urged upwardly while the triangular plate 32 pivots clockwise (in relation to FIGS. 1 and 3) and the boot 60 is gripped between the protective strips 44 and 46 as shown in FIG. 5. Continued lifting against the handle 40 will cause the boot 60 to slip onto the foot of the wearer. Thereafter, pressure on the moveable handle is released and the boot puller can be removed from the boot by lifting upwardly on the fixed handle 12.

The strips 44 and 46 need not necessarily be made of leather or rubber providing they are made of a material which will grab onto the material of the boot without damaging the same.

Whereas the present invention has been disclosed in terms of the specific structure described above, it should be understood that other and further modifications, apart from those shown or suggested herein, may be made within the spirit and scope of this invention.

I claim:

1. A boot puller for pulling a boot onto the foot of a wearer comprising an elongated hollow tube having an upper fixed handle and a lower boot engaging portion, the boot engaging portion including a housing, a clamp pivotally mounted in the housing, a vertical stop normally spaced from the pivotal clamp, a vertical rod extending downwardly from above the top of the vertical tube, through the tube, and to a lower end which operatively connects with the pivotal clamp so as to move the clamp toward the stop upon lifting of the rod, the rod having an upper end which connects to the center of a short horizontal and moveable handle, whereby when the boot puller is slipped over the upper rear end of a boot such that the end of the boot is positioned between the clamp and the stop, the wearer can place his fingers beneath the moveable handle while the wearer's foot is inserted into the boot, the rod is urged upwardly while the clamp pivots so that the boot is gripped between the clamp and the stop, and whereby continued lifting against the moveable handle will cause the boot to slip onto the foot of the wearer.

2. A boot puller as set forth in claim 1 wherein a triangular plate is pivotally mounted in the housing, wherein the clamp is pivotally connected to the triangular plate, and wherein the lower end of the rod is pivotally connected to the triangular plate, whereby lifting of the rod will pivot the triangular plate which, in turn, causes pivotal movement of the clamp toward the stop.

3. A boot puller as set forth in claim 1 wherein the stop is provided with a convex surface adjacent the clamp, wherein the clamp is provided with a concave surface normally spaced from the convex surface, and wherein strips of leather-engaging material are attached to the convex and concave surfaces, whereby the boot can be gripped between the strips of leather-engaging material.

4. A boot puller for pulling a boot onto the foot of a wearer comprising an elongated hollow tube having an upper fixed handle and a lower boot engaging portion, the boot engaging portion including a horizontal arm connected at one side end to a lower end of the tube, a pair of spaced vertical arms extending downwardly from the ends of the horizontal arm, the lower end of one vertical arm connecting with a narrow horizontal plate which extends toward the other vertical arm but terminates at a spaced distance therefrom to form an opening, a pair of spaced vertical plates extending upwardly from the sides of the horizontal plate and connecting at their upper ends with the horizontal arm to one side of the tube, a triangular plate pivotally mounted between the two vertical plates, a vertical rod extending downwardly from above the top of the vertical tube, through the tube, and to a lower end which is bent at right angles to the rod and which engages a hole in the triangular plate, the upper end of the rod being connected to the center of a short horizontal rod which constitutes a moveable handle, a clamp being mounted between the two vertial plates, the clamp having a concave vertical edge adjacent to the other vertical arm, a first strip of protective material attached to the concave edge of the clamp, the edge of the other vertical arm having a convex edge facing the concave edge of the clamp, a second strip of protective material attached to the convex edge of the other vertical arm, the protective strips being adjacent but spaced from each other, the clamp being provided with a pair of spaced ears which extend over the one end of the triangular plate, the ears pivotally connecting the clamp to the triangular plate, the arrangement of the pivotal connections and the hole in the plate being such that an upward lifting of the rod will cause the clamp to move towards the other vertical arm, whereby when the boot puller is slipped over the upper rear end of a boot such that the end of the boot is positioned between the clamp and the other vertical arm, the wearer can place his fingers beneath the moveable handle while the wearer's foot is inserted into the boot, the rod is urged upwardly while the triangular plate pivots so that the boot is gripped between the protective strips, and whereby continued lifting against the moveable handle will cause the boot to slip onto the foot of the wearer.

* * * * *